US005853051A

United States Patent [19]

Buchanan et al.

[11] Patent Number: 5,853,051

[45] Date of Patent: Dec. 29, 1998

[54] ADJUSTABLE TOP LINK ASSEMBLY

[75] Inventors: Brian C. Buchanan, Clayton, N.C.; John M. Dickerson, East Peoria, Ill.; James E. Johnston, Apex, N.C.; Francis G. Snekhaus, Bartonville, Ill.

[73] Assignee: Caterpillar, Inc., Peoria, Ill.

[21] Appl. No.: 824,946

[22] Filed: Mar. 27, 1997

[51] Int. Cl.[6] ..... E02F 3/76

[52] U.S. Cl. ..... 172/824; 172/818; 172/822; 403/59

[58] Field of Search ..... 172/811, 810, 172/816, 817, 818, 820, 821, 822, 823, 824, 825, 2; 403/59, 61, 76

[56] References Cited

U.S. PATENT DOCUMENTS

| | | | |
|---|---|---|---|
| 2,216,572 | 10/1940 | Nichols, Jr. | 172/825 X |
| 2,648,997 | 8/1953 | Sawyer | 403/59 X |
| 2,816,375 | 12/1957 | Anderson | 172/811 X |
| 3,729,844 | 5/1973 | Deglan | 172/811 X |
| 3,867,987 | 2/1975 | Seaberg | 172/811 X |
| 4,464,852 | 8/1984 | Rice | 172/811 X |
| 4,478,289 | 10/1984 | Enix | 172/811 X |
| 5,209,596 | 5/1993 | Matczak et al. | 403/76 X |
| 5,507,352 | 4/1996 | Frisbee et al. | 172/818 |

FOREIGN PATENT DOCUMENTS

| | | | |
|---|---|---|---|
| 1201421 A | 12/1985 | U.S.S.R. | 172/811 |

*Primary Examiner*—Michael J. Carone
*Assistant Examiner*—Victor Batson
*Attorney, Agent, or Firm*—Diana L. Charlton

[57] ABSTRACT

Top link assemblies for a construction machine are typically used to adjust the pitch angle of a cutting edge of a blade. The present top link assembly has substantially co-planar first and second adjustment plates with each including a pair of slots therein. Joint upper and lower surfaces are defined between the first and second adjustment plates. Upper and lower spacer plates are disposed on the joint upper and lower surfaces, respectively, and each include a pair of openings coaxially aligned with the slots within the first and second adjustment plates. A threaded portion of a bolt extends through the upper spacer plate, first and second adjustment plates and lower spacer plate through the co-axially aligned openings and slots. A nut is tightened on the threaded portion at any one of a plurality of positions along the pair of slots and the desired pitch angle of the cutting edge may be adjusted by loosening the nuts and repositioning at any one of the plurality of positions. The ability to adjust the pitch angle without removing the top link assembly increases productivity and decreases costs.

8 Claims, 4 Drawing Sheets

ADJUSTABLE TOP LINK ASSEMBLY

TECHNICAL FIELD

This invention relates generally to a top link assembly for use on a blade assembly of a construction machine and more particularly to the adjustability of the cutting angle of the blade assembly through the use of the top link assembly.

BACKGROUND ART

Present top link assemblies for connecting a blade assembly to a frame of a construction machine require a joint assembly which is flexible to achieve the desired range of motion for the blade assembly and a linkage which can be adjusted to vary the pitch of the blade assembly for a multitude of cutting angle positions.

Most top link assemblies currently have flexible joint assemblies and adjustable linkages. The adjustable linkages which are utilized, however, generally require that the entire linkage be disassembled with various components either being replaced, removed or reinstalled after the adjustment to the cutting angle has been made. Additionally, during this adjustment process, shims and other devices may be used to attain the desired pitch of the cutting angle. The disassembly of the linkage for each pitch adjustment of the blade assembly cutting angle limits productivity and increases costs.

The present invention is directed to overcoming the problems as set forth above.

DISCLOSURE OF THE INVENTION

In one aspect of the present invention, an adjustable top link assembly is disclosed for connecting a blade assembly to a frame. The top link assembly comprises a first adjustment plate movably connected by a first joint assembly to the blade assembly. The first adjustment plate has a head portion with a defined bore therethrough and a planar end portion extending a predetermined distance from the head portion with an adjustment slot having a predetermined length defined therethrough. A second adjustment plate is movably connected by a second joint assembly to the frame. The second adjustment plate has a head portion with a defined bore therethrough and a planar end portion extending a predetermined distance from the head portion with an adjustment slot having a predetermined length defined therethrough. The planar end portion of the second adjustment plate is positioned adjacent the planar end portion of the first adjustment plate and is substantially co-planar therewith. A threaded fastener extends through each of the adjustment slots on the planar end portions of the first and the second adjustment plates. Each of the threaded fasteners is operatively associated with a nut to secure the top link assembly in a plurality of positions extending along the predetermined length of the adjustment slots.

In another aspect of the present invention, a method for adjusting the pitch angle of a blade assembly for a construction machine having a frame comprises the steps of movably connecting a first adjustment plate through a first joint assembly to the blade assembly. The first adjustment plate has a head portion with a defined bore therethrough. A planar end portion extends a predetermined distance from the head portion with a pair of adjustment slots having a predetermined length therethrough. Next, movably connecting a second adjustment plate through a second joint assembly to the frame. The second adjustment plate has a head portion with a defined bore therethrough. A planar end portion extends a predetermined distance from the head portion with a pair of adjustment slots having a predetermined length defined therethrough. Then, positioning the planar end portion of the second adjustment plate adjacent and co-planar with the planar end portion of the first adjustment plate. Next, positioning an upper spacer plate defining a pair of openings at a blade end portion and a pair of openings at a frame end portion on an upper surface defined by the first and second adjustable plates. Then, positioning a lower spacer plate defining a pair of opening at a blade end portion and a pair of openings at a frame end portion on a lower surface defined by the first and second adjustable plates. Next, coaxially aligning each of the pair of openings in the blade end portion of the upper spacer plate and the lower spacer plate with the adjustment slots in the first adjustment plate and coaxially aligning each of the pair of openings in the frame end portion of the upper spacer plate and the lower spacer plate with the adjustment slots in the second adjustment plate. Then, extending a threaded fastener through each of the coaxially aligned pair of openings in the upper spacer plate, the adjustment slots on the planar end portion of the first and second adjustment plates and each of the pair of openings in the lower spacer plate so that a threaded portion of the threaded fasteners extends beyond the lower spacer plate. Next, threading a nut on each of the extending threaded portions of the threaded fasteners to removably connect the first and second adjustment plates. Then, moving the first and second adjustment plates relative to one another along the predetermined length of the adjustment slots on the planar end portions to select a first of any plurality of positions therealong which achieves a desired pitch angle of the blade assembly. Finally, tightening the nuts on each of the extending threaded portions of the threaded fasteners to secure the first and second adjustment plates at the first selected position along the predetermined length of the adjustment slots on the planar end portions.

The present invention, through the use of first and second adjustment plates with adjustment slots therethrough provide a method of adjusting the pitch angle of a blade assembly for a construction machine without disassembling the entire top link assembly. The ability to adjust the pitch angle in such a manner increases productivity and decreases associated labor costs.

BEST MODE FOR CARRYING OUT THE INVENTION

Figure 1:
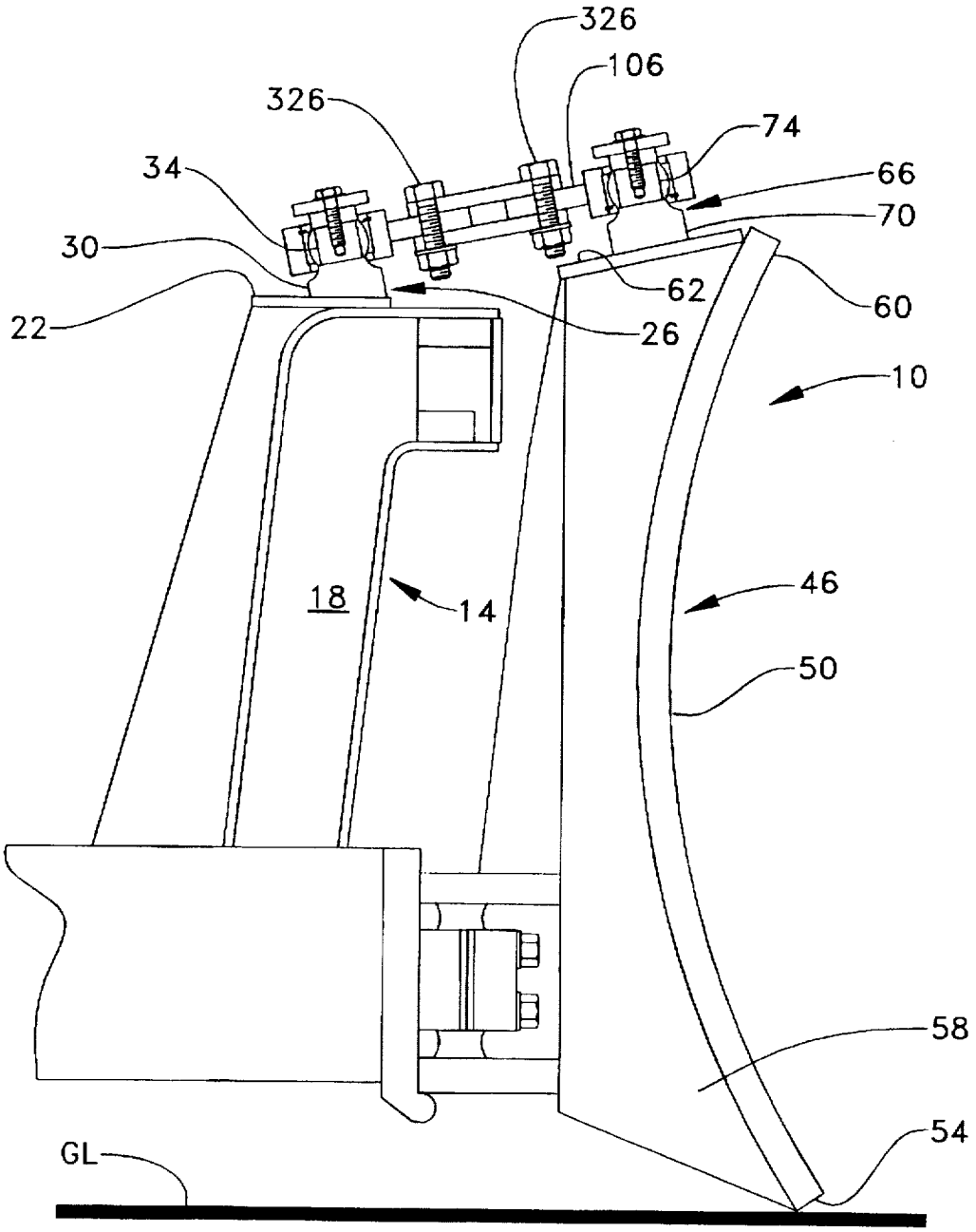
FIG. 1 is a partial side view of a frame tower assembly and blade assembly for a construction machine embodying a connection therebetween by the present invention.

A construction machine 10 with a frame assembly 14 is partially shown in FIG. 1. The frame assembly 14 includes a frame tower 18 connected at a front portion of the frame assembly 14. The frame tower 18 extends upwardly from the frame assembly 14 a predetermined distance and includes an uppermost planar surface 22. A frame tower pin 26 is attached at a base portion 30 in a well know manner, such as welding, to the uppermost planar surface 22 and extends therefrom a predetermined distance and terminates at a solid pin portion 34. The solid pin portion 34 defines a threaded bore 38 therein which extends a predetermined distance downwardly from an upper surface 42.

A blade assembly 46 is releasably connected to the frame assembly 14 in a well known manner, such as through a pivot. The blade assembly 46 has a blade portion 50 with a cutting edge 54 positioned at a lower portion 58 thereof and an upper portion 60. The blade assembly 46 has an upper planar surface 62 which is positioned at a greater height from a ground location GL than the uppermost planar surface 22 of the frame tower 18. It should be understood, however, that the upper planar surface 62 may be located at a lower height from the ground location GL. The upper planar surface 62 of the blade assembly 46 is disposed at an angle relative to the uppermost planar surface 22 of the frame tower 18. It should be understood, however, that no angle is necessary to achieve the desired result. A blade pin 66 is attached at a base portion 70 in a well know manner, such as welding, to the upper planar surface 62 and extends therefrom a predetermined distance and terminates at a solid pin portion 74. The blade pin 66 is positioned at a predetermined distance away from the pivot. The solid pin portion 74 defines a threaded bore 78 therein which extends a predetermined distance downwardly from an upper surface 82.

Figure 2:
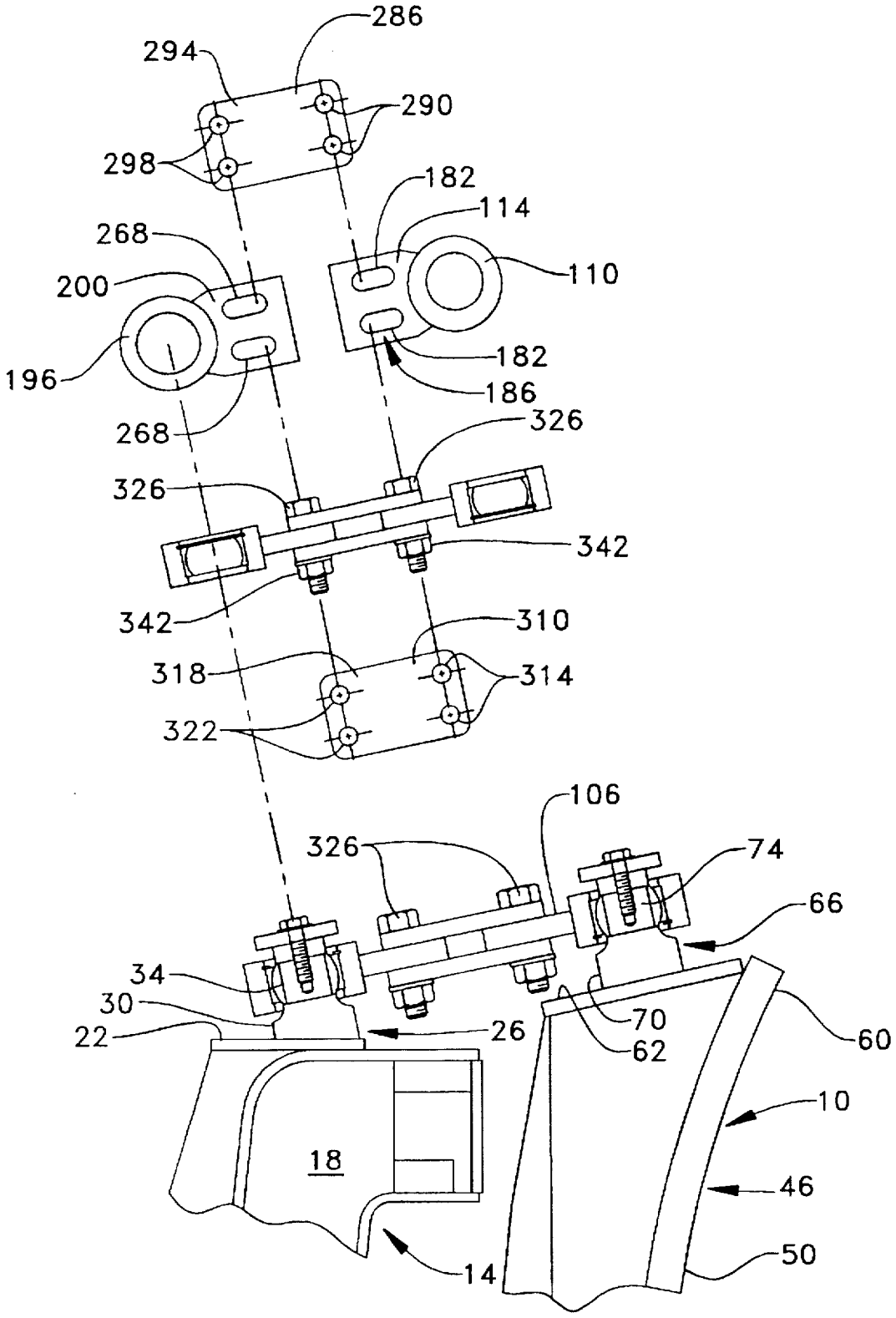
FIG. 2 is an exploded view of the present invention connecting the frame tower assembly and blade assembly shown in FIG. 1.
Figure 3:
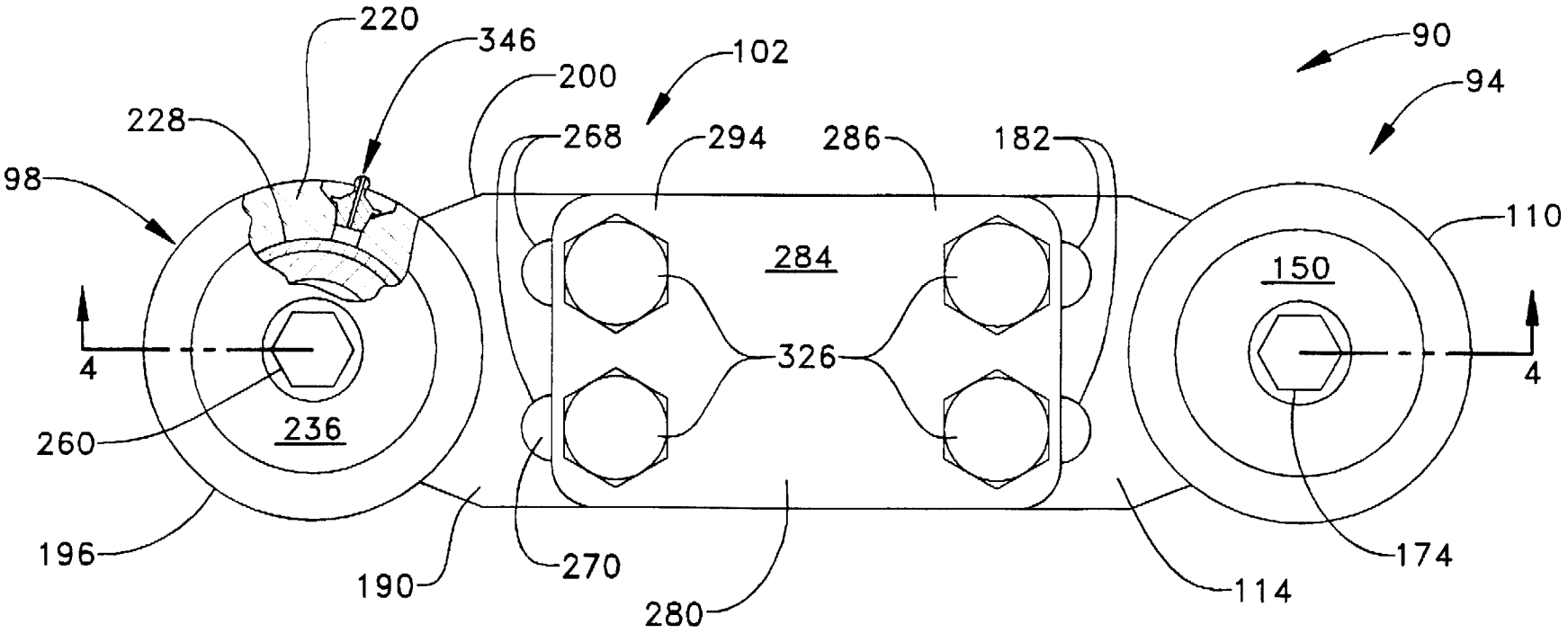
FIG. 3 is a top view of the present invention.
Figure 4:
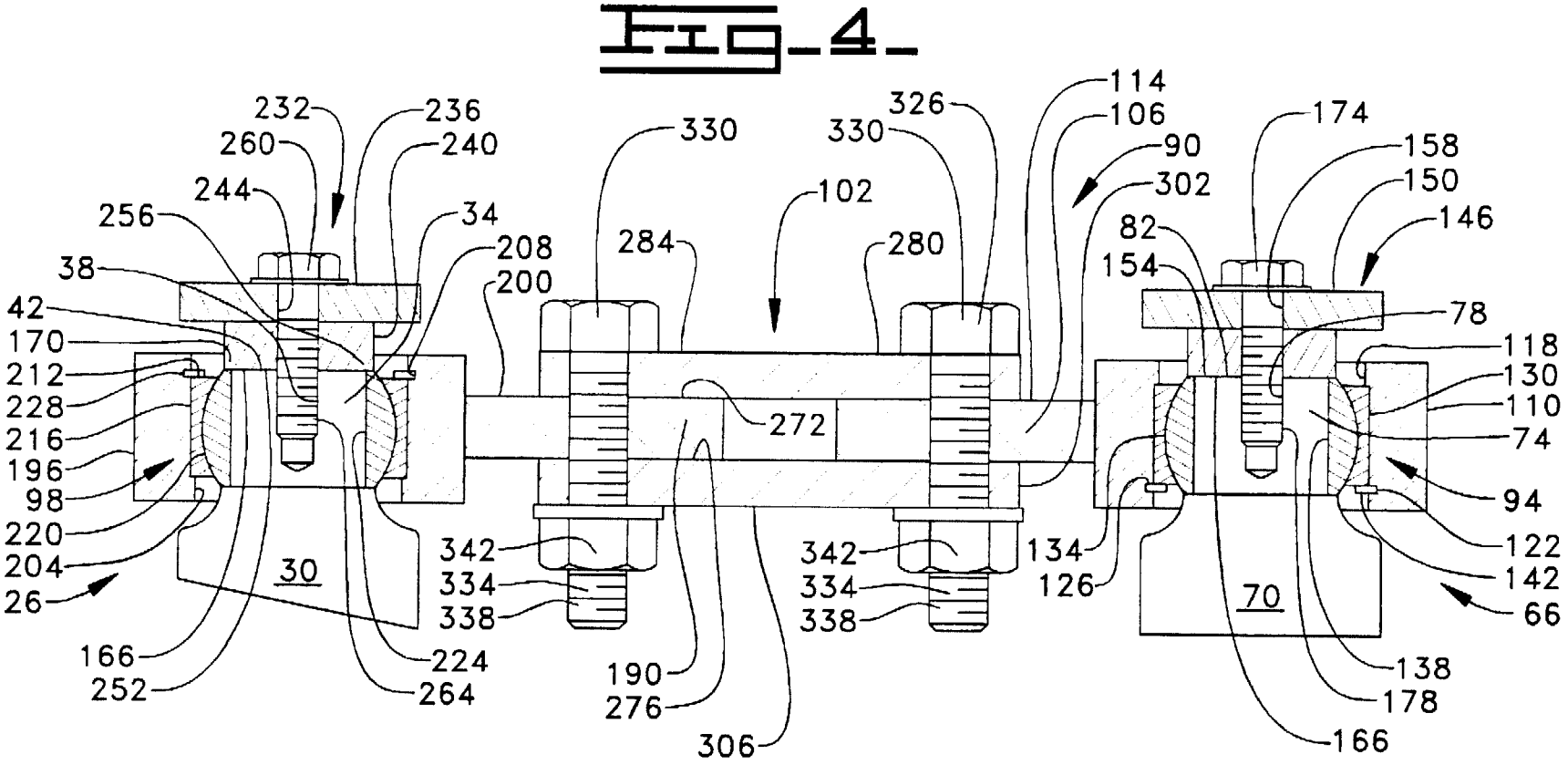
FIG. 4 is a section view of the present invention taken along line 4—4 of FIG. 3.

An adjustable top link assembly 90, seen more clearly in FIG. 2–4, is connected from the blade assembly 46 to the frame assembly 14 at a first joint assembly 94 movably connected to the blade pin 66 and a second joint assembly 98 movably connected to the frame tower pin 26 to define a method 102 for adjusting the pitch angle of the blade assembly 46. A first adjustment plate 106 has a head portion 110 and a planar end portion 114 extending a predetermined distance from the head portion 110. The head portion 110 has a substantially circular shape with a bore 118 extending therethrough. The bore 118 has an annulus 122 therearound which defines a shoulder region 126. The shoulder region 126 is located at a lower portion 130 of the bore 118. A first spherical bearing assembly 134 with an interior bore 138 is pressed within the bore 118 and is held therein by a retaining ring 142 positioned within the annulus 122 in a well known manner. The pin portion 74 of the blade pin 66 is slidably disposed within the interior bore 138 of the first spherical bearing assembly 134. A protective plate assembly 146 including a securing plate 150 and a cover plate 154 each having a coaxially aligned bore 158 therethrough are disposed at the upper surface 82 of the pin portion 74 of the blade pin 66. A bottom surface 166 of the cover plate 154 is adjacent the upper surface 82 and includes a protective portion 170 extending beyond the upper surface 82 to partially cover in a contacting relation a portion of the first spherical bearing assembly 134. A bolt 174 extends through the bores 158 of the securing plate 150 and the cover plate 154 and includes a threaded portion 178 which is threaded into the threaded bore 78 of the pin portion 74 of the blade pin 66 and is tightened to secure the blade pin 66 within the first spherical bearing assembly 134. The planar end portion 114 of the first adjustment plate 106 has a pair of slots 182 therethrough which have a predetermined length. It should be understood that the length of the slots 182 may vary with the blade assembly 46 geometry and desired range of pitch adjustment. The pair of slots 182 define a plurality of positions 186 therealong. A second adjustment plate 190 has a head portion 196 and a planar end portion 200 extending a predetermined distance from the head portion 196 toward the planar end portion 114 of the first adjustment plate 106. The head portion 196 has a substantially circular shape with a bore 204 extending therethrough. The bore 204 has an annulus 208 therearound which defines a shoulder region 212. The shoulder region 212 is located at an upper portion 216 of the bore 204. It should be understood that the location of the shoulder regions 126,212 within the bores 118,204 of the first and second adjustment plates 106,190 may be located at any position therealong dependent on the design requirements. A second spherical bearing assembly 220 with an interior bore 224 is pressed within the bore 204 and is held therein by a retaining ring 228 positioned within the annulus 208 in a well known manner. The pin portion 34 of the frame tower pin 26 is slidably disposed within the interior bore 224 of the second spherical bearing assembly 220. A protective plate assembly 232 including a securing plate 236 and a cover plate 240 each having a coaxially aligned bore 244 therethrough are disposed at the upper surface 42 of the pin portion 34 of the frame tower pin 26. A bottom surface 252 of the cover plate 240 is adjacent the upper surface 42 and includes a protective portion 256 extending beyond the upper surface 42 to partially cover in a contacting relation a portion of the second spherical bearing assembly 220. A bolt 260 extends through the bores 244 of the securing plate 236 and the cover plate 240 and includes a threaded portion 264 which is threaded into the threaded bore 38 of the pin portion 34 of the frame tower pin 26 and is tightened to secure the frame tower pin 26 within the second spherical bearing assembly 220. The planar end portion 200 of the second adjustment plate 190 has a pair of slots 268 therethrough which have a predetermined length. It should be understood that the length of the slots 268 may vary with the blade assembly 46 geometry and desired range of pitch adjustment. The pair of slots 268 define a plurality of positions 270 therealong operatively associated with the plurality of positions 186 on the first adjustment plate 106. The planar end portion 200 of the second adjustment plate 190 is substantially co-planar with the planar end portion 114 of the first adjustment plate 106 and is spaced therefrom to define a joint upper surface 272 and a joint lower surface 276.

An upper spacer plate 280 is seated on the joint upper surface 272 to partially extend across the planar end portions 114,200 of the first and second adjustment plates 106,190, respectively. The upper spacer plate 280 has an upper surface 284 and a blade end portion 286 with a pair of openings 290 therethrough each coaxially aligned with one of the pair of slots 182 in the planar end portion 114 of the first adjustment plate 106. The upper spacer plate 280 has a frame end portion 294 with a pair of openings 298 therethrough each coaxially aligned with one of the pair of slots 268 in the planar end portion 200 of the second adjustment plate 190. A lower spacer plate 302 is seated on the joint lower surface 276 to partially extend across the planar end portions 114,200 of the first and second adjustment plates 106,190, respectively. The lower spacer plate 302 has a lower surface 306 and a blade end portion 310 with a pair of openings 314 therethrough each coaxially aligned with one of the pair of slots 182 in the planar end portion 114 of the first adjustment plate 106. The lower spacer plate 302 has a frame end portion 318 with a pair of openings 322 therethrough each coaxially aligned with one of the pair of slots 268 in the planar end portion 200 of the second adjustment plate 190. A bolt 326 has a head portion 330 and a threaded end portion 334 which extends downwardly from the upper spacer plate 280 through each of the coaxially aligned openings 290 in the upper spacer plate 280, the slots 182,268 in the first and second adjustment plates 106,190 and the openings 314 in the lower spacer plate 302 until a portion 338 thereof extends beyond the lower spacer plate 302 and the head portion 330 is seated against the upper surface 284 of the upper spacer plate 280. A nut 342 is threaded on each extending threaded portion 338 of the bolts 326 until it is tightened against the lower surface 306 of the lower spacer plate 302 to secure the first adjustment plate 106 to the second adjustment plate 190 at any position along the predetermined length of the slots 182,268, respectively. Means 346 for greasing the first and second spherical bearing assemblies 134,220 is disposed within the head portions 110,196 of the first and second adjustment plates 106,190. The greasing means 346 may be of any suitable type, such as a grease zerk, capable of communicating fluid, such as oil or grease, externally from a source to the first and second bearing assemblies 134,220.

Industrial Applicability

Adjustment of the pitch of the cutting edge 54 of the blade portion 50 of the blade assembly 46 is accomplished through the utilization of the adjustable top link assembly 90. The lower portion 58 of the blade assembly 46 is positioned on the ground location GL and the blade assembly is held at the lower portion 58 through the pivot. The nuts 342 connected to the bolts 326 are loosened and the first and second adjustment plates 106,190 are moved relative to one another along the predetermined length of the adjustment slots 182,268 on the planar end portions 114,200 thereof to increase the overall length of the top link assembly 90. The nuts 342 are tightened on each of the extending threaded portions 334 of the bolts 326 at any one of the plurality of positions 186,270 along the pair of slots 182,268 of the first and second adjustment plates 106,190, respectively, to achieve a desired pitch angle of the cutting edge 44 of the blade portion 50. Extending the length of the top link assembly 90 at an upper portion 60 of the blade 50 and the frame tower 18 while holding the lower portion 58 of the blade 50 enables the pitch angle of the cutting edge 44 of the blade portion 50 to be adjusted. The further the distance of the blade pin 66 from the pivot allows for decreased loading on the top link assembly 90 and, therefore, on the bolts 326. The top link assembly 90 additionally prevents the blade 50 from pitching randomly at various cutting angles due to the ability to firmly hold the blade 50 at a selected pitch angle during operation.

Other aspects, objects and advantages of this invention can be obtained from a study of the drawings, disclosure and the appended claims.

We claim:

1. An adjustable top link assembly for connecting a blade assembly to a frame, comprising:

a first adjustment plate adapted to be movably connected by a first joint assembly to the blade assembly, the first adjustment plate having a head portion with a defined bore therethrough and a planar end portion extending a predetermined distance from the head portion with an adjustment slot having a predetermined length defined therethrough;

a second adjustment plate adapted to be movably connected by a second joint assembly to the frame, the second adjustment plate having a head portion with a defined bore therethrough and a planar end portion extending a predetermined distance from the head portion with an adjustment slot having a predetermined length defined therethrough, the planar end portion of the second adjustment plate positioned adjacent the planar end portion of the first adjustment plate and being substantially co-planar therewith; and a spacing mechanism adjacent the first and second adjustment plates with a pair of defined openings therethrough, each one of the pair of openings substantially coaxially aligned with a respective one of the adjustment slots on the first and second adjustment plates; and a threaded fastener extending through each of the adjustment slots on the planar end portions of the first and the second adjustment plates and respective openings on the spacing mechanism and being operatively associated with a nut to secure the top link assembly in a plurality of positions extending along the predetermined length of the adjustment slots.

2. The adjustable top link assembly of claim 1, wherein the first adjustment plate is adapted to be connected by the first joint assembly to an upper substantially planar surface of the blade assembly and the second adjustment plate is adapted to be connected by the second joint assembly to an uppermost substantially planar surface of the frame.

3. The adjustable top link assembly of claim 1, wherein the first joint assembly has a first spherical bearing defining a bore therethrough pressed within the bore of the head portion of the first adjustment plate and secured therein by a first retaining ring, the second joint assembly has a second spherical bearing defining a bore therethrough pressed within the bore of the head portion of the second adjustment plate and secured therein by a second retaining ring, a first pin extending from an upper substantially planar surface of the blade assembly and having an end portion slidably disposed within the bore of the first spherical bearing and secured thereto and a second pin extending from an upper substantially planar surface of the frame and having an end portion slidably disposed within the bore of the second spherical bearing and secured thereto.

4. The adjustable top link assembly of claim 1, wherein the spacing mechanism includes an upper spacer plate defining a pair of openings therethrough and positioned on an upper surface defined by the first and second adjustment plates and a lower spacer plate defining a pair of openings therethrough is positioned on a lower surface defined by the first and second adjustment plates with one of the threaded fasteners extending through each of the pair of openings in the upper and lower spacer plates and seated at an upper surface of the upper spacer plate and each of the nuts being seated at a lower surface of the lower spacer plate.

5. The adjustable top link assembly of claim 4, wherein another adjustment slot is defined through the planar end portion of each of the first and second adjustment plates and another pair of openings are defined on the upper and lower spacer plates with another threaded fastener extending through each of the another pair of openings in the upper and lower spacer plates and the another adjustment slots through the planar end portion of the first and second adjustment plates and each another threaded fastener being operatively associated with a nut to secure the top link assembly in a plurality of positions extending along the predetermined length of the adjustment slots in cooperation with the other threaded fasteners extending through each of the adjustment slots on the planar end portions of the first and the second adjustment plates and the other securing nuts.

6. The adjustable top link assembly of claim 3, wherein each of the end portions of the first and second pins define a threaded bore therein and a protective plate assembly defining a bore therethrough is positioned at adjacent each of the first and second pins at the end portion thereof, each of the protective plate assemblies having a bottom surface extending beyond the end portions of the respective first and second pins and overlapping in contacting relation a portion of the each of the first and second spherical bearings with a bolt extending through each of the bores in the protective plate assemblies and threaded into the threaded bores in the respective first and second pins.

7. A method for adjusting the pitch angle of a blade assembly for a construction machine having a frame, comprising the steps of:

movably connecting a first adjustment plate through a first joint assembly to the blade assembly, the first adjustment plate having a head portion with a defined bore therethrough and a planar end portion extending a predetermined distance from the head portion with a pair of adjustment slots having a predetermined length therethrough;

movably connecting a second adjustment plate through a second joint assembly to the frame, the second adjustment plate having a head portion with a defined bore therethrough and a planar end portion extending a predetermined distance from the head portion with a pair of adjustment slots having a predetermined length defined therethrough;

positioning the planar end portion of the second adjustment plate adjacent and co-planar with the planar end portion of the first adjustment plate;

positioning an upper spacer plate defining a pair of openings at a blade end portion and a pair of openings at a frame end portion on an upper surface defined by the first and second adjustable plates;

positioning a lower spacer plate defining a pair of openings at a blade end portion and a pair of openings at a frame end portion on a lower surface defined by the first and second adjustable plates;

coaxially aligning each of the pair of openings in the blade end portion of the upper spacer plate and the lower spacer plate with the adjustment slots in the first adjustment plate and coaxially aligning each of the pair of opening in the frame end portion of the upper spacer plate and the lower spacer plate with the adjustment slots in the second adjustment plate;

extending a threaded fastener through each of the coaxially aligned pair of openings in the upper spacer plate, the adjustment slots on the planar end portion of the first and second adjustment plates and each of the pair of openings in the lower spacer plate so that a threaded portion of the threaded fasteners extends beyond the lower spacer plate;

threading a nut on each of the extending threaded portions of the threaded fasteners to removably connect the first and second adjustment plates;

moving the first and second adjustment plates relative to one another along the predetermined length of the adjustment slots on the planar end portions to select a first of any plurality of positions therealong which achieves a desired pitch angle of the blade assembly; and tightening the nuts on each of the extending threaded portions of the threaded fasteners to secure the first and second adjustment plates at the first selected position along the predetermined length of the adjustment slots on the planar end portions.

8. The method of adjusting the pitch angle of the blade assembly of claim 7, including the steps of:

loosening the nuts on each of the extending threaded portions of the threaded fasteners;

moving the first and second adjustment plates relative to one another along the predetermined length of the adjustment slots on the planar end portions to select a second of any of the plurality of positions therealong different from the first selected position; and tightening the nuts on each of the extending threaded portions of the threaded fasteners to secure the first and second adjustment plates at the second selected position along the predetermined length of the adjustment slots on the planar end portions.

* * * * *